US007735802B2

(12) United States Patent
Akabane

(10) Patent No.: US 7,735,802 B2
(45) Date of Patent: Jun. 15, 2010

(54) DAMPER DEVICE

(75) Inventor: Tokuyuki Akabane, Nagano (JP)

(73) Assignee: Nidec Sankyo Corporation (JP)

( * ) Notice: Subject to any disclaimer, the term of this patent is extended or adjusted under 35 U.S.C. 154(b) by 300 days.

(21) Appl. No.: 11/866,690

(22) Filed: Oct. 3, 2007

(65) Prior Publication Data

US 2008/0078452 A1 Apr. 3, 2008

(30) Foreign Application Priority Data

Oct. 3, 2006 (JP) ..... 2006-272127

(51) Int. Cl.
*F16K 31/04* (2006.01)

(52) U.S. Cl. ..... 251/77; 251/129.11; 251/228; 251/229; 251/298

(58) Field of Classification Search ..... 251/298, 251/129.11–129.13, 228, 229, 77, 129.19, 251/297; 92/408; 62/187, 408
See application file for complete search history.

(56) References Cited

U.S. PATENT DOCUMENTS 2,389,947 A * 11/1945 Allen ..... 251/228
3,119,594 A * 1/1964 Heggem ..... 251/228
3,334,858 A * 8/1967 Hay ..... 251/228
5,499,658 A * 3/1996 Bridges ..... 251/298
5,501,427 A * 3/1996 Ando ..... 251/228
5,876,014 A * 3/1999 Noritake et al. ..... 251/129.12
6,877,716 B2 * 4/2005 Noritake ..... 251/129.12
2005/0076670 A1 * 4/2005 Noritake et al. ..... 62/408
2006/0081296 A1 * 4/2006 Schwartz et al. ..... 137/614.11

FOREIGN PATENT DOCUMENTS

JP 64-48571 3/1989

* cited by examiner

*Primary Examiner*—John Bastianelli
(74) *Attorney, Agent, or Firm*—Cantor Colburn LLP

(57) ABSTRACT

A damper device may include a frame provided with an opening part, a baffle turnably supported on the frame, and a drive unit for turnably driving the baffle to open and close the opening part. The drive unit may include an output member whose tip end side is provided with an engagement part with the baffle and which is linearly advanced and retreated to and from the baffle to turnably drive the baffle. Further, the damper device includes a wall part provided between the driving part and the baffle and formed with an output hole part through which the output member is penetrated. The engagement part is located apart from a first moving extended axis which is formed by movement of the output member penetrating through the output hole part.

4 Claims, 8 Drawing Sheets

4,41
32R
30R
2
40R
9R
9L
3
32L
30L
42R
42L
40L
43R
43L
410
381
90R
30
326
90L
328
36
35
34
C
A
A'
453
81R
451
452
45R
810
325
385
372
371
387R
38
31
326

Fig. 5(a)
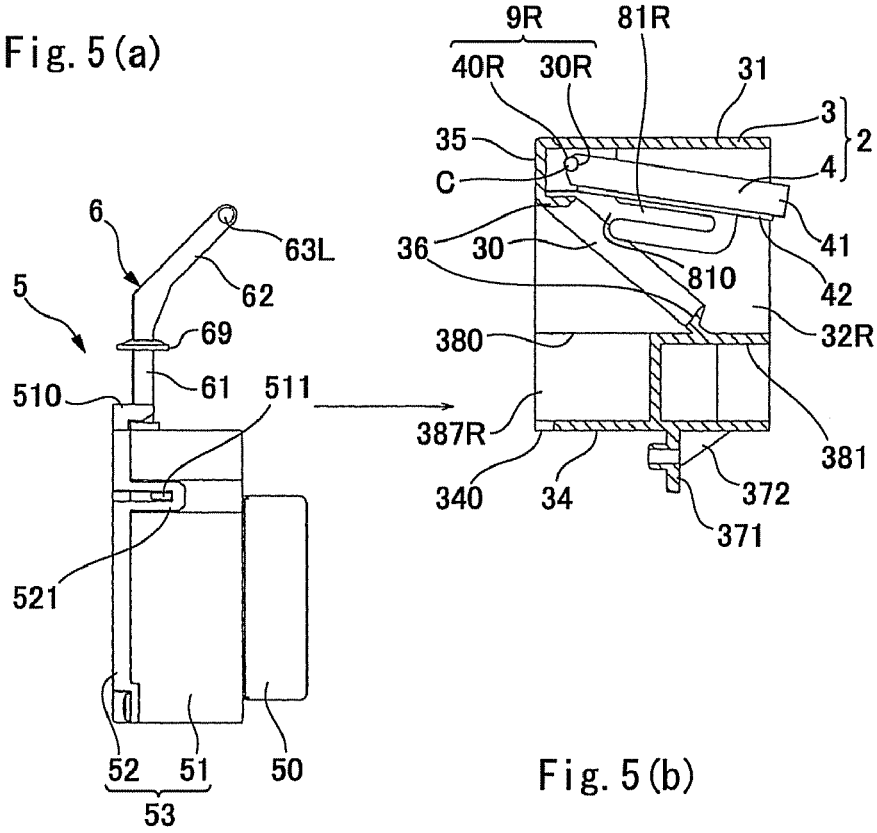
Fig. 5(b)
Fig. 5(c)
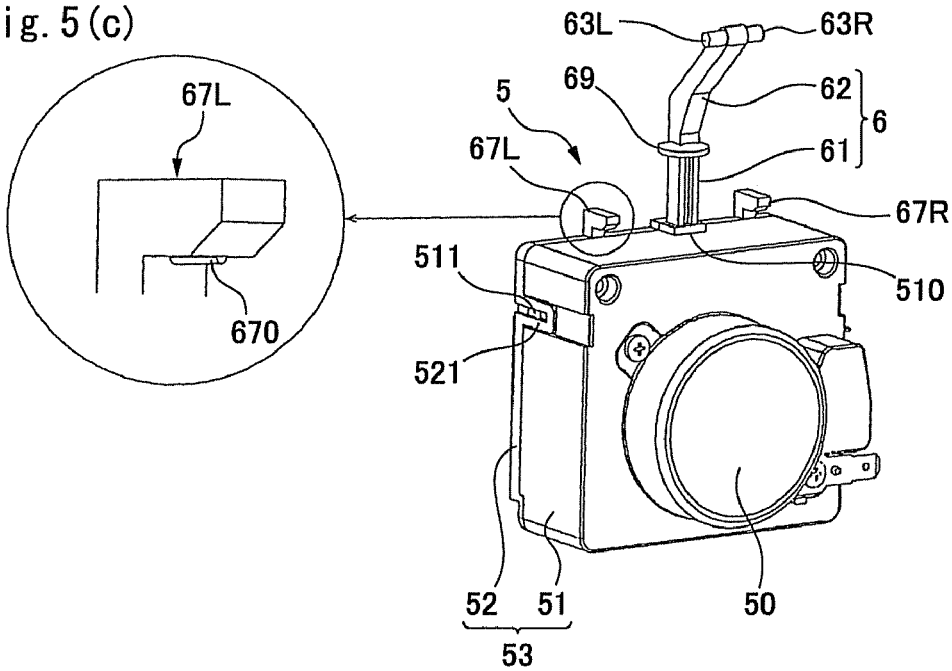

DAMPER DEVICE

CROSS REFERENCE TO RELATED APPLICATION

The present invention claims priority under 35 U.S.C. §119 to Japanese Application No. 2006-272127 filed Oct. 3, 2006, which is incorporated herein by reference.

FIELD OF THE INVENTION

An embodiment of the present invention may relate to a damper device which is provided with a baffle for opening or closing a passage for fluid.

BACKGROUND OF THE INVENTION

A damper device has been used in a refrigerator or in an air-conditioner for opening/closing a passage for fluid. The damper device includes a frame, a baffle which is turnably supported on the frame, and a drive unit for turnably driving the baffle. The passage through which fluid is passed is opened and closed by the baffle which is turned. Therefore, the above-mentioned damper device is often structured that the drive unit is connected with a turning shaft of the baffle to turnably drive the baffle (see, for example, Japanese Utility Model Laid-Open No. Sho 64-048571).

However, when the drive unit is connected to the turnable support part for the baffle, the drive unit is disposed on the turning center axial line of the baffle and thus dimension in a baffle turning axial direction of the damper device becomes large.

SUMMARY OF THE INVENTION

An embodiment of the present invention may advantageously provide a damper device which is capable of reducing a dimension in a turning axial direction of a baffle.

Thus, according to an embodiment of the present invention, there may be provided a damper device including a frame which is provided with an opening part, a baffle which is turnably supported on the frame to abut with the opening part and move away from the opening part, and a drive unit for turnably driving the baffle to open and close the opening part for opening and closing a passage through which fluid is passed. The drive unit includes an output member whose tip end side is provided with an engagement part with the baffle and which is linearly advanced and retreated to and from the baffle to turnably drive the baffle, and a driving part for advancing and retreating the output member. The damper device further includes a wall part which is provided between the driving part and the baffle and which is formed with an output hole part through which the output member is penetrated. The output member penetrating through the output hole part is engaged with the baffle through the engagement part, and the engagement part is located apart from a first moving extended axis which is formed by movement of the output member penetrating through the output hole part.

In accordance with an embodiment of the present invention, the baffle is turned by advancing and retreating operation of the output member and thus the drive unit is not required to be disposed on the turning center axial line of the baffle and dimension in the baffle turning axial direction can be reduced. In addition, the engagement part is located apart from the first moving extended axis which is formed by movement of the output member at a position where the output member penetrates through the output hole part. Therefore, the position of the engagement part is not required to be restricted by the position of the output hole part and thus degree of freedom on design can be improved.

In accordance with an embodiment of the present invention, the turning axial line of the baffle is apart from a second moving extended axis which is formed by movement of the engagement part, and the turning axial line of the baffle is parallel to a flat face including the opening part.

In accordance with an embodiment of the present invention, the second moving extended axis of the engagement part is more apart from the turning axial line of the baffle than the first moving extended axis of the output member. According to the structure as described above, the engagement part and the turning axial line of the baffle can be disposed to be apart from each other. Therefore, a torque for turnably driving the baffle can be reduced in comparison with a case that the baffle and the output member are engaged with each other on the first moving extended axis of the output member penetrating through the output hole part.

In accordance with an embodiment of the present invention, the turning axial line of the baffle is located on or in a vicinity of the first moving extended axis of the output member. According to the structure as described above, the engagement part can be disposed at a position apart from the first moving extended axis of the output member and thus the engagement part is located at a position apart from the turning axial line of the baffle to turnably drive the baffle. In addition, a space on the output member side of the baffle is not required to be divided by the output member and thus it is easy to use the space effectively.

In accordance with an embodiment of the present invention, the engagement part is provided at a position apart from the first moving extended axis of the output member through a bent portion which is formed in the output member.

In accordance with an embodiment of the present invention, the wall part is structured in a case in which the driving part is held, and the case is provided with a linear guide part which is engaged with at least a part of the output member, and the linear guide part guides the output member to move linearly. According to the structure as described above, the engagement part is located apart from the first moving extended axis of the output member at a position of the output member on the baffle side of the output hole part. Therefore, the position of the output hole part and the linear guide part in the case are not required to modify regardless of the positions of the output hole part and the engagement part. Accordingly, the case is not required to modify regardless of the positions of the output hole part and the engagement part.

In accordance with an embodiment of the present invention, at least a part of the output member is structured to be adjacent to an inner wall of the case. When the output member is disposed to be adjacent to the inner wall of the case, rigidity of the linear guide part which is formed in the wall face of the case in the vicinity of the output member can be easily enhanced.

In accordance with an embodiment of the present invention, a width of the drive unit is set to be within a width of the frame in a direction where the second moving extended axis of the engagement part is apart from the first moving extended axis of the output member. According to the structure as described above, the drive unit is not protruded from the frame in the direction where the second moving extended axis of the engagement part is apart from the first moving extended axis of the output member and thus a size of the device can be reduced.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 5(*a*) is an explanatory view showing a method for connecting a drive unit to the baffle unit in the damper device shown in FIGS. 1(*a*) and 1(*b*), FIG. 5(*b*) is a perspective view showing the drive unit, and FIG. 5(*c*) is an explanatory perspective view showing a rib-shaped projection which is formed in the drive unit.

DETAILED DESCRIPTION OF THE PREFERRED EMBODIMENTS

An embodiment of the present invention will be described below with reference to the accompanying drawings.

Figure 1:
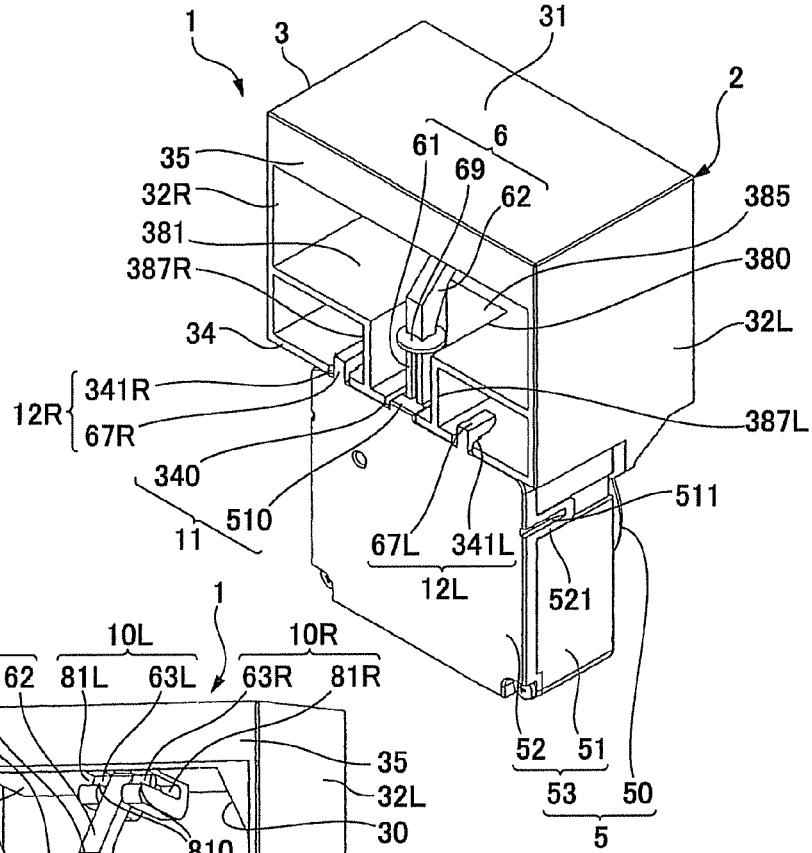
FIG. 1(*a*) is a perspective view showing a rear face side of a damper device in accordance with an embodiment of the present invention which is viewed from obliquely above, and FIG. 1(*b*) is its perspective view which is viewed from obliquely below.
Figure 1:
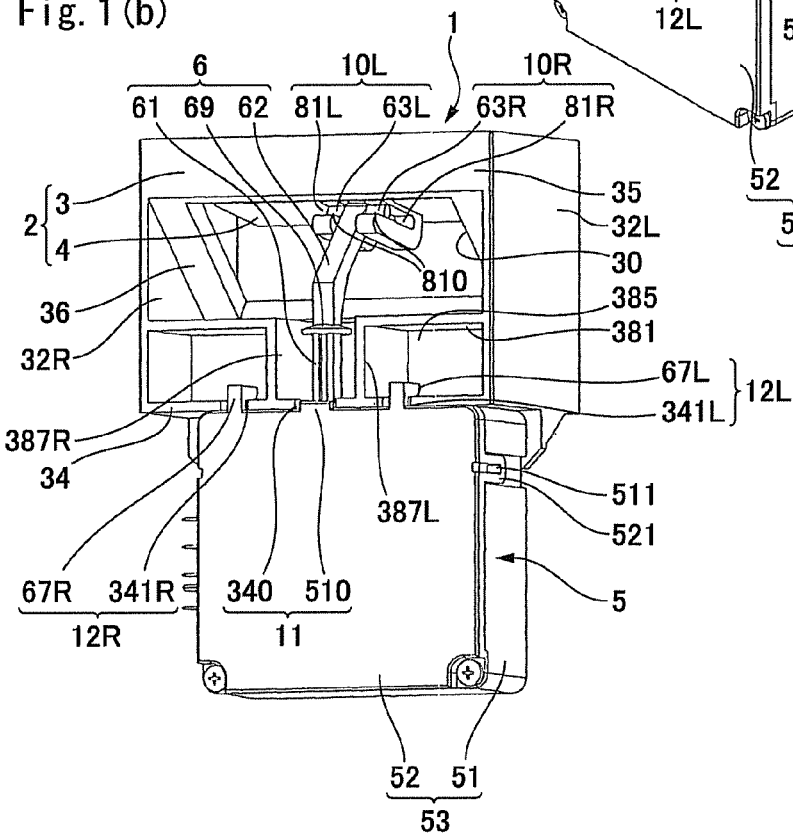
Figure 2:
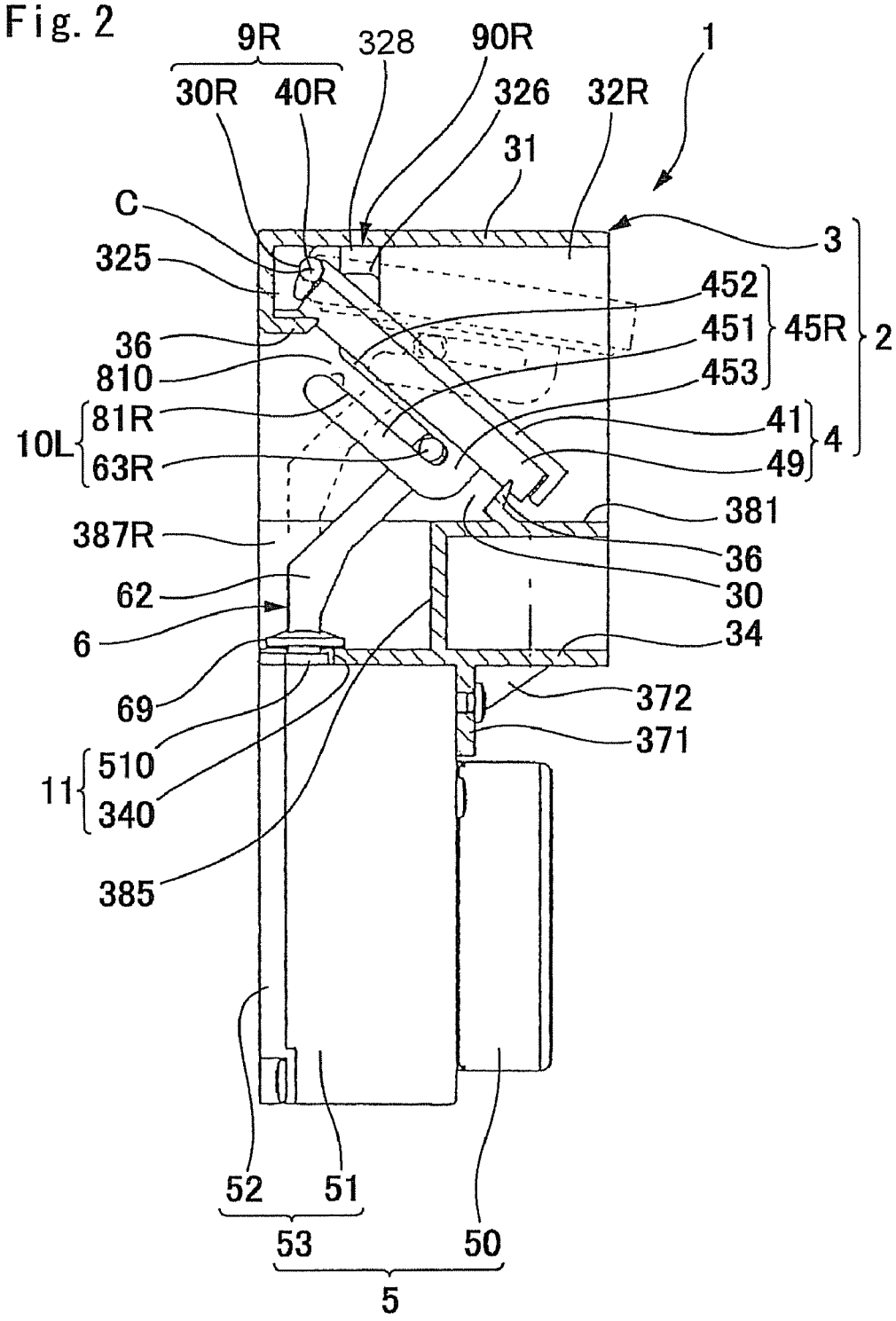
FIG. 2 is a longitudinal sectional view showing the damper device shown in FIGS. 1(*a*) and 1(*b*).
Figure 3:
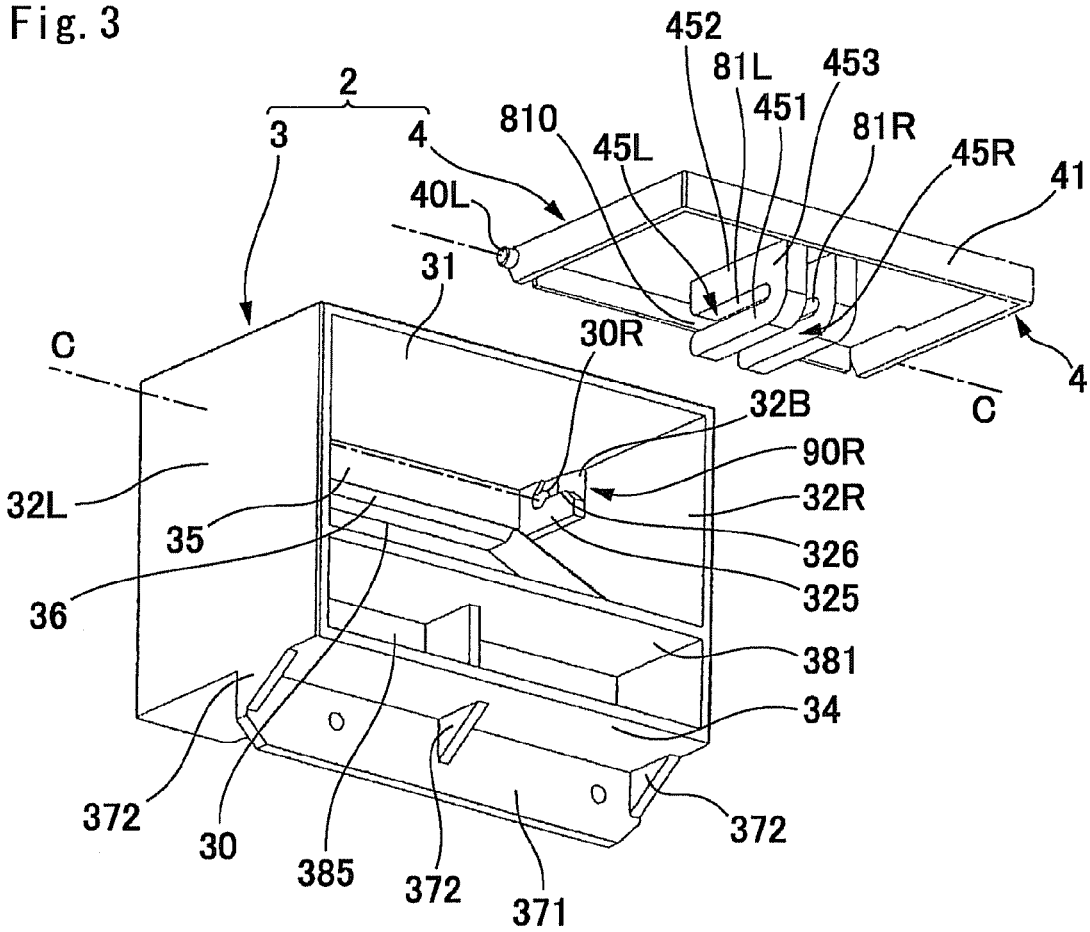
FIG. 3 is an explanatory view showing a baffle unit of the damper device shown in FIGS. 1(*a*) and 1(*b*) which is disassembled into a frame and a baffle.

FIG. 1(*a*) is a perspective view showing a rear face side of a damper device in accordance with an embodiment of the present invention which is viewed from obliquely above, and FIG. 1(*b*) is its perspective view which is viewed from obliquely below. FIG. 2 is a longitudinal sectional view showing the damper device shown in FIGS. 1(*a*) and 1(*b*). FIG. 3 is an explanatory view showing a baffle unit of the damper device shown in FIGS. 1(*a*) and 1(*b*) which is disassembled into a frame and a baffle. In FIG. 3, a buffer member is detached from the baffle.

A damper device 1 shown in FIG. 1(*a*) through FIG. 2 is a device for controlling supply of cold air to a storage chamber in a refrigerator. The damper device 1 is generally structured of a baffle unit 2 which is provided with a baffle 4 within a frame 3 and a drive unit 5 which is connected to an under face of the baffle unit 2. In the baffle unit 2, the frame 3 is formed in a case shape which is provided with a rectangular upper plate part 31, rectangular right and left side plate parts 32L and 32R, a rectangular bottom plate part 34 and a rear plate part 35. A rear end part of the bottom plate part 34 is formed with a cutout part 340, i.e., an example of an output hole part, through which an output member 6 is passed as described below, at a center position in a widthwise direction of the bottom plate part 34. Cutout parts 341L and 341R with which hook parts 67L and 67R described below are engaged are formed on both sides of the cutout part 340. The frame 3 is provided in the inside of the frame 3 with a horizontal intermediate plate part 381 which faces the bottom plate part 34. The rear end side of the horizontal intermediate plate part 381 is formed with a cutout part 380 i.e., an example of an output hole part, through which the output member 6 is passed as described below at a center position in a widthwise direction of the horizontal intermediate plate part 381. The horizontal intermediate plate part 381 is connected with the bottom plate part 34 through a perpendicular intermediate plate part 385 and two perpendicular side plate parts 387L and 387R. A space through which the output member 6 is passed is formed between the two perpendicular side plate parts 387L and 387R. The perpendicular intermediate plate part 385 closes a space between the horizontal intermediate plate part 381 and the bottom plate part 34 in a front and rear direction.

An under face of the bottom plate part 34 is formed with a connecting plate part 371 which is protruded downward. An upper side of a front face of the drive unit 5 is abutted with the connecting plate part 371 and fastened to it with a screw. The connecting plate part 371 and the bottom plate part 34 are connected with each other by using triangular reinforcing plate parts 372.

In accordance with an embodiment of the present invention, a front part of the frame 3 is formed in a completely open state and the rear plate part 35 covers an upper portion of a rear face part of the frame 3. Further, a rectangular frame part 36 which is formed in an obliquely upward direction is formed in the inside of the frame 3 so as to protrude on an inner side from the respective inner side faces of the upper plate part 31, the side plate parts 32L and 32R and the bottom plate part 34. The frame 3 is penetrated through the opening part 30 of the rectangular frame part 36 in the front and rear direction. A tip end part of the rectangular frame part 36 is formed in a sharp shape toward the baffle 4.

In this embodiment, a rear face part of the frame 3 is formed in a flat face with the rear end plate 52 of the drive unit 5. A motor 50 is disposed on an opposite face to the rear end plate 52 of the drive unit 5, and the motor 50 is not protruded from the front part of the frame 3. Therefore, a width of the drive unit in a direction where a moving extended axis of the engagement part is located apart from a moving extended axis of the output member at a penetrating position through an output hole part can be set within a range of a width of the frame and thus the dimension in the widthwise direction can be reduced. In this embodiment, the rear face part of the frame 3 and the rear end plate 52 of the drive unit 5 are formed in a flat face but they are not necessary to be formed in a flat face.

As described above, a passage through which fluid is passed is formed within the inside of the frame 3 and the baffle 4 controls flow of fluid by opening or closing the opening part 30. In this embodiment, the baffle 4 is supported by the frame 3 so as to be capable of turning around a horizontal axial line (turning center axial line "C") on a front side of the opening part 30 (front side of the rectangular frame part 36). Therefore, the baffle 4 is turned around the horizontal axial line to be changed to a closed position as shown by the solid line in FIG. 2 and to an open position as shown by the dotted line in FIG. 2. The baffle 4 is provided with a box-shaped baffle plate 41 made of resin and a buffer member 49 made of rubber or the like which is fixed on a rear face of the baffle plate 41. The baffle 4 is disposed such that the buffer member 49 is located on the opening part 30 side.

As shown in FIGS. 2 and 3, two arm parts 45L and 45R are formed at a roughly center area in a widthwise direction of the rear face of the baffle 4. The two arm parts 45L and 45R are extended in parallel to each other in the front and rear direction at a position which is shifted from the turning center axial line "C". The respective arm parts 45L and 45R are provided with a protruded part 453 protruding from the baffle 4 to its rear side and a rail portion 451 which is extended from the protruded part 453 in a direction crossing the turning center axial line "C" of the baffle 4 to form grooves 81L and 81R on the rear side of the baffle 4. In addition, the arm parts 45L and 45R are respectively provided with rail portions 452 which are extended in parallel to each other so as to have a certain space to the rail portion 451. These rail portions 451 and 452 are connected with each other at one end side to be formed in a U-shape. In accordance with an embodiment, the rail portion 452 is fixed to the baffle plate 41 and the rail portion 451 is floated from the rear face of the baffle 4.

In this embodiment, the two arm parts 45L and 45R are respectively disposed such that the U-shaped connecting part (protruded part 453) is located at a far side from the turning center axial line "C" and an open end 810 is located at a closer position to the turning center axial line "C". Therefore, the two grooves 81L and 81R are respectively formed such that one end part which is located at the closer position to the turning center axial line "C" is formed in the open end 810 in a longitudinal direction of the grooves 81L and 81R, and the other end part which is located at the far side from the turning center axial line "C" is closed.

Figures 4A, 4B, 4C, 4D, 4E, 4F:
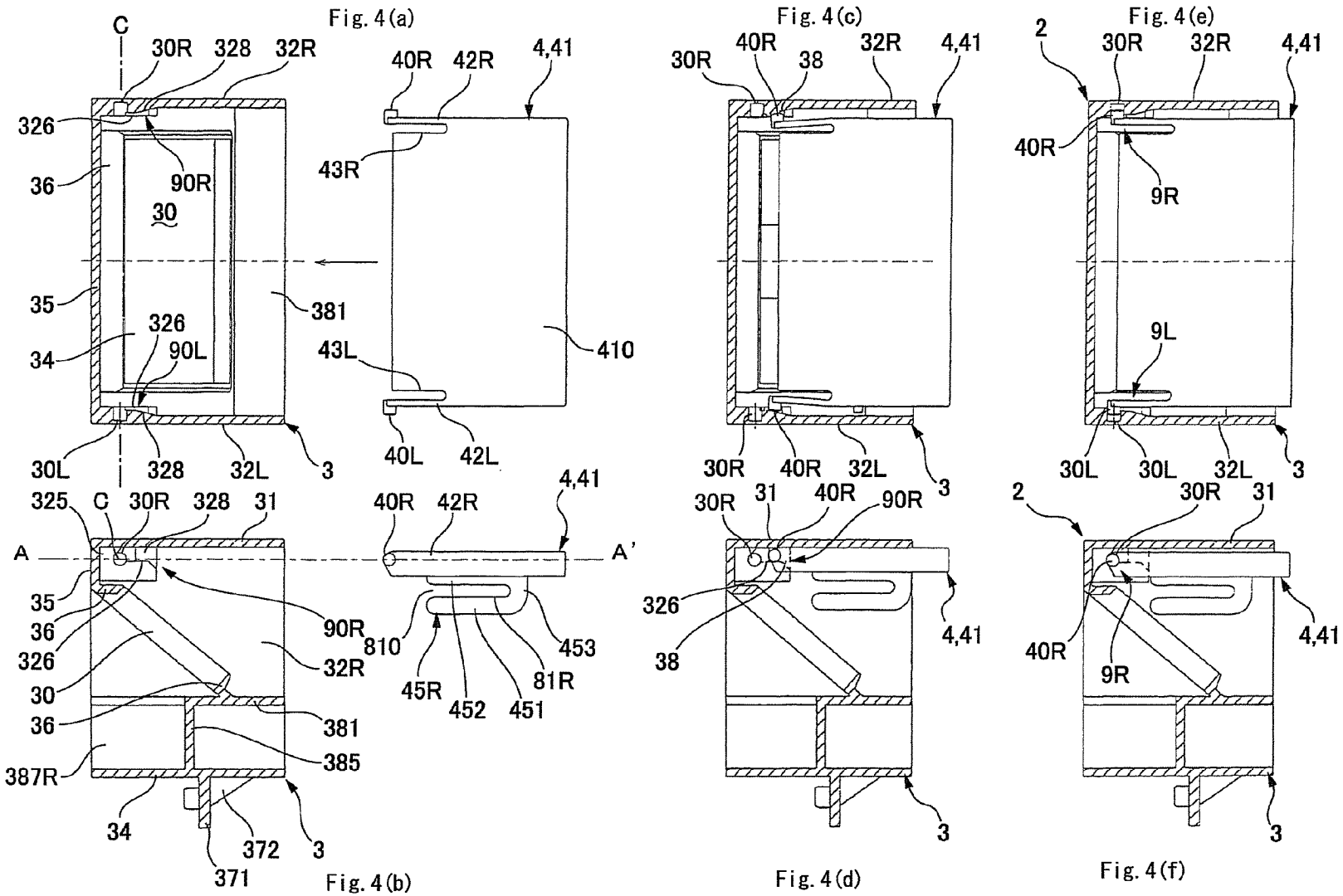
FIGS. 4(*a*) through 4(*f*) are explanatory views showing a method for attaching the baffle to the frame in the damper device shown in FIGS. 1(*a*) and 1(*b*).

FIGS. 4(*a*) through 4(*f*) are explanatory views showing a method for attaching the baffle to the frame in the damper device shown in FIGS. 1(*a*) and 1(*b*). Specifically, FIG. 4(*a*) is a transverse cross-sectional view showing the frame and the baffle, and FIG. 4(*b*) is their longitudinal sectional view. FIG. 4(*c*) is a transverse cross-sectional view showing a state that the baffle is going to be mounted on the frame and FIG. 4(*d*) is its longitudinal sectional view. FIG. 4(*e*) is a transverse cross-sectional view showing a state that the baffle has been mounted on the frame and FIG. 4(*f*) is its longitudinal sectional view. FIGS. 4(*a*), 4(*c*) and 4(*d*) correspond to a cross-sectional view which is cut with the line "A-A'" in FIG. 4(*b*).

In this embodiment, in order to structure that the baffle 4 is turnably supported by the frame 3, the following structure is utilized which is described with reference to FIGS. 2 and 3 and FIGS. 4(*a*) through 4(*f*). In other words, as shown in FIGS. 2, 3 and 4(*a*), the baffle 4 is provided with cylindrical shaft parts 40L and 40R which are protruded from the respective right and left side face parts 42L and 42R on the rear end side of a baffle plate 41. On the other hand, the frame 3 is provided with shaft holes 30L and 30R which are formed at an upper position on the rear end side on inner side faces of the right and left side plate parts 32L and 32R. When the right and left shaft parts 40L and 40R are respectively fitted to the right and left shaft holes 30L and 30R, a first turnable support part 9L and a second turnable support part 9R are structured near the rear end of the frame 3.

In accordance with an embodiment of the present invention, the right and left shaft parts 40L and 40R are formed on the rear end parts of the right and left side face parts 42L and 42R of the baffle plate 41. The right and left side face parts 42L and 42R are formed so as to be partially separated from a main body portion of the baffle plate 41 by slits 43L and 43R which are extended to a midway position on a front side from its rear end portion. Therefore, the rear end parts of the right and left side face parts 42L and 42R are capable of deforming like a flat spring in the right and left direction, and the right and left shaft parts 40L and 40R are capable of displacing in an axial direction of the shaft parts 40L and 40R.

In the right and left side plate parts 32L and 32R of the frame 3, a plate thickness of a portion where the shaft holes 30L and 30R are formed is made to be larger than other portion. Therefore, the right and left shaft holes 30L and 30R are formed in a bottomed hole but they can be provided with a sufficient depth dimension. In accordance with an embodiment of the present invention, since the right and left shaft holes 30L and 30R are formed in a bottomed hole, the shaft holes 30L and 30R are opened in the inner side face of the side plate parts 32L and 32R but they are not penetrated to their outer side face.

In the right and left side plate parts 32L and 32R, surrounding portions of the shaft holes 30L and 30R are formed such that a portion other than a front side portion is formed in a platform-shaped protruded part 325. The protruded part 325 is extended in a roughly parallel manner to an under face of the upper plate part 31 to a position facing the under face of the upper plate part 31 with a predetermined gap space so that a guide wall 326 facing the under face of the upper plate part 31 is provided in the protruded part 325. Therefore, the frame 3 is formed with guide parts 90L and 90R by an inner side face (guide wall 326) of the protruded part 325 and the under face of the upper plate part 31 for sliding and guiding side faces of the shaft parts 40L and 40R when the shaft parts 40L and 40R are to be fitted to the shaft holes 30L and 30R. Further, in the right and left side plate parts 32L and 32R, a plate thickness of portions where the shaft holes 30L and 30R are formed is made larger than that of other portion. In addition, their tip end portions are formed in a tapered face 328 whose thickness is gradually increased to the shaft holes 30L and 30R. The shaft holes 30L and 30R are opened at a face which is continuously formed at the same height position as the highest portion of the tapered face 328.

In order to assemble the baffle unit 2 by using the frame 3 and the baffle 4 which are structured as described above, as shown in FIG. 3 and FIGS. 4(*a*) and 4(*b*), the baffle 4 is inserted from a front side of the frame 3. In this case, the shaft parts 40L and 40R of the baffle 4 are slid on the under face of the upper plate part 31 of the frame 3. As a result, as shown in FIGS. 4(*c*) and 4(*d*), when the shaft parts 40L and 40R are entered into the guide parts 90L and 90R, the tip end parts of the shaft parts 40L and 40R are pushed by the tapered faces 328 of the side plate parts 32L and 32R and thus the rear end portions of the side face parts 42L and 42R are resiliently bent on the inner side. Therefore, the shaft parts 40L and 40R are moved toward the shaft holes 30L and 30R while the shaft parts 40L and 40R are displaced to the inner side. Further, the side faces of the shaft parts 40L and 40R are guided by the guide parts 90L and 90R which are formed with the guide wall 326 of the protruded part 325 and the under face of the upper plate part 31 to reach to the shaft holes 30L and 30R.

After that, as shown in FIGS. 4(*e*) and 4(*f*), when the shaft parts 40L and 40R have been reached to the shaft holes 30L and 30R, the rear end portions of the side face parts 42L and 42R are returned from the state that the rear end portions have resiliently bent to the inner side and the shaft parts 40L and 40R are displaced to the outer side. As a result, the shaft parts 40L and 40R are fitted into the shaft holes 30L and 30R and thus a first turnable support part 9L and a second turnable support part 9R are structured which turnably support the baffle 4 to the frame 3.

As described above, in this embodiment of the present invention, the shaft parts 40L and 40R are elastically displaceable in their axial directions. Therefore, when the shaft parts 40L and 40R are fitted into the shaft holes 30L and 30R, the shaft parts 40L and 40R are displaced in an opposite direction to the fitting direction and thus the shaft parts 40L and 40R are fitted into the shaft holes 30L and 30R easily. Further, after the shaft parts 40L and 40R have been fitted into the shaft holes 30L and 30R, the shaft parts 40L and 40R or the shaft holes 30L and 30R are going to be returned to their original positions. Therefore, a state where the shaft parts 40L and 40R have been fitted into the shaft holes 30L and 30R are maintained. Moreover, when the shaft parts 40L and 40R are to be fitted into the shaft holes 30L and 30R, the tip end parts of the shaft parts 40L and 40R are slid on the tapered faces 328. Therefore, the shaft parts 40L and 40R have been displaced on an opposite side to their fitting directions and then the shaft parts 40L and 40R are rapidly displaced in the fitting direction to the shaft holes 30L and 30R and fitted into the shaft holes 30L and 30R. Accordingly, when the shaft parts 40L and 40R are to be fitted into the shaft holes 30L and 30R, a click feeling is obtained and, after the shaft parts 40L and 40R have been fitted into the shaft holes 30L and 30R, the shaft parts 40L and 40R are not disengaged.

In addition, in this embodiment, the frame 3 is formed with guide parts 90L and 90R for sliding and guiding the side faces of the shaft parts 40L and 40R to the shaft holes 30L and 30R. Therefore, even when the positions of the shaft holes 30L and 30R cannot be observed directly, the shaft parts 40L and 40R are easily an surely fitted into the shaft holes 30L and 30R.

Further, plate thicknesses of the surrounding portions of the shaft holes 30L and 30R in the frame 3 are set to be larger than those of other portions. Therefore, when the shaft holes 30L and 30R are to be formed in the frame 3, the shaft holes 30L and 30R having a sufficient depth can be formed and thus a structure in which the shaft parts 40L and 40R are surely fitted into the shaft holes 30L and 30R can be realized. Further, only the plate thicknesses of the surrounding portions of the shaft holes 30L and 30R are set to be larger than that of other portion of the frame 3 and thus the entire thickness of the frame 3 is not required to increase. Moreover, the shaft holes 30L and 30R are formed of a bottomed hole which is not penetrated through to an outer side of the frame 3 and the shaft holes 30L and 30R are closed by the outer face of the frame 3. Therefore, foreign matter is prevented from entering into the shaft holes 30L and 30R from the outside and turning of the baffle 4 is prevented from being disturbed by the foreign matter. Accordingly, reliability of the damper device 1 can be enhanced.

Figure 6A:
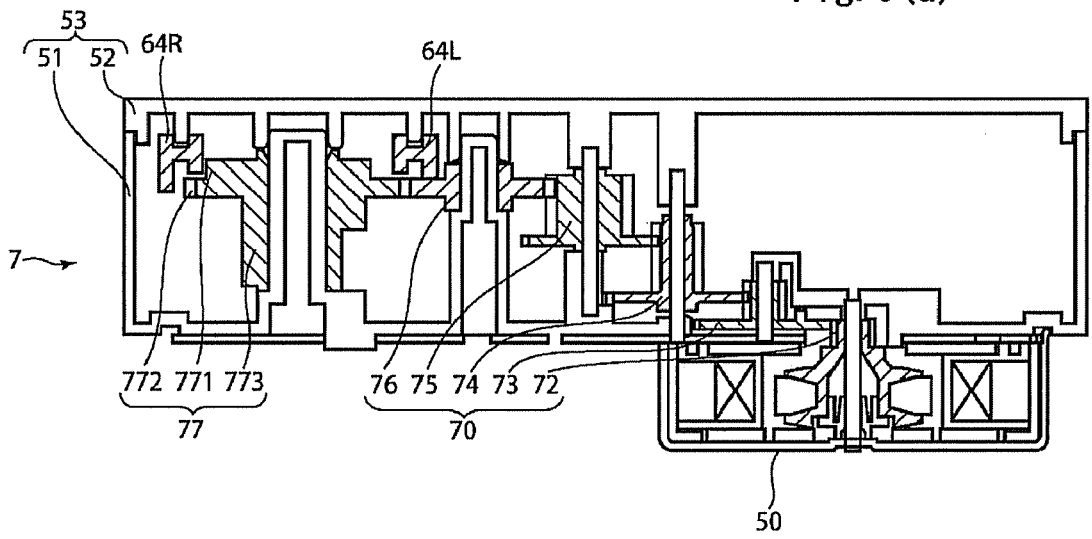
FIG. 6(*a*) is a cross-sectional view showing the drive unit which is to be connected to the baffle unit in the damper device shown in FIGS. 1(*a*) and 1(*b*), and FIG. 6(*b*) is a perspective view showing the drive unit in which a rear end plate is detached from the drive unit.
Figure 6B:
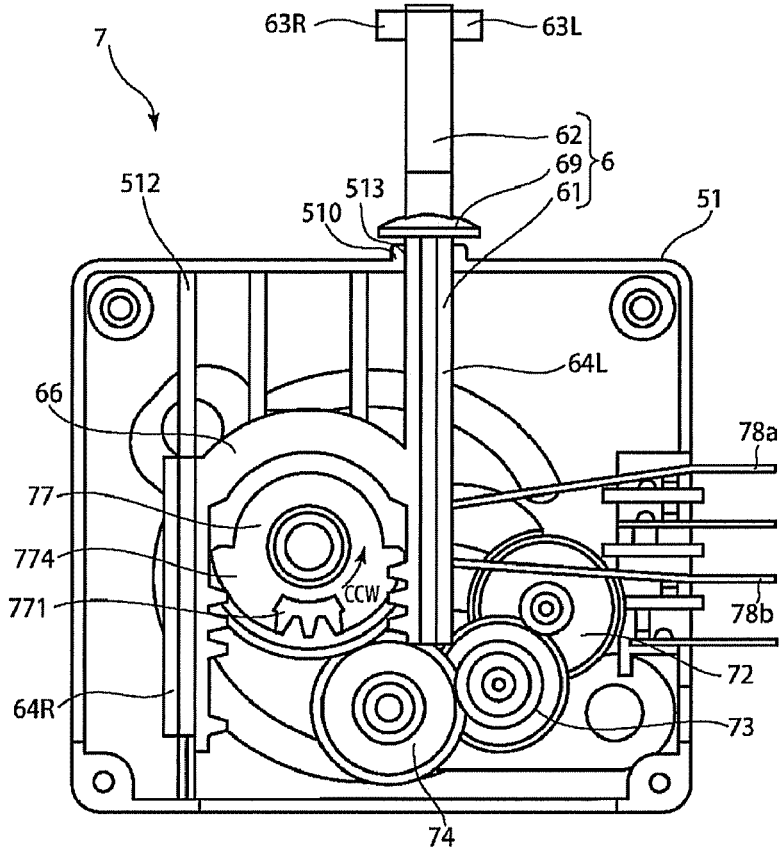

FIG. 5(*a*) is an explanatory view showing a method for connecting a drive unit to the baffle unit in the damper device shown in FIGS. 1(*a*) and 1(*b*), FIG. 5(*b*) is a perspective view showing the drive unit, and FIG. 5(*c*) is an explanatory perspective view showing rib-shaped projection which is formed in the drive unit. FIG. 6(*a*) is a cross-sectional view showing the drive unit which is to be connected to the baffle unit in the damper device shown in FIGS. 1(*a*) and 1(*b*), and FIG. 6(*b*) is a perspective view showing the drive unit in which a rear end plate is detached from the drive unit.

The drive unit 5 is provided with a housing 53 which is structured of a bottomed rectangular and tubular case 51 whose upper face is abutted with the under face of the bottom plate part 34 of the baffle unit 2 and a rear end plate 52 which closes a rear opening of the case 51. A motor 50 such as an AC synchronous motor is fixed to a front face of the housing 53 on its outer side. A shaft-shaped output member 6 is protruded from the upper face of the housing 53. An opening part 513 as an output hole part which is formed of a cut-out part formed in an upper face of the case 51 as a wall part and the rear end portion is formed on the rear end face side of the housing 53 for protruding the output member 6 from the housing 53. A plurality of engaging plate parts 521 is formed in the rear end plate 52 for fitting the rear end plate 52 to the case 51, and holes of the engaging plate parts 521 are engaged with projections 511 which are formed on the side face of the case 51.

The drive unit 5 in this embodiment is provided with a driving force transmission mechanism for transmitting a driving force from a motor to the output member 6 within the inside of the housing 53. In this embodiment, the driving force transmission mechanism includes a speed reducing gear train 70 through which rotation of the motor is transmitted while being decelerated, a rotation-linear motion converting mechanism by using a rack and a pinion, and the like. The output member 6 is advanced or retreated in an axial direction by rotation of the motor 50.

In the speed reducing gear train 70, a motor pinion 72 which is integrally structured with an output shaft of the motor 50 is engaged with a large gear part of a first gear 73, a small gear part of the first gear 73 which is integrally formed with the large gear part of the first gear 73 is engaged with a large gear part of a second gear 74, a small gear part of the second gear 73 which is integrally formed with a large gear part of the second gear 74 is engaged with a large gear part of a third gear 75, a small gear part of the third gear 75 which is integrally formed with a large gear part of the third gear 75 is engaged with a fourth gear 76, the fourth gear 76 is engaged with a fifth gear 772 of a cam gear 77, and a drive teeth part 771 which is integrally structured with the fifth gear 772 is capable of engaging with racks 64L and 64R of the output member 6. The racks 64L and 64R are integrally structured as a piece of member through a connecting part 66.

In FIG. 6(*b*), the drive teeth part 771 is not engaged with both the racks 64L and 64R, and the racks 64L and 64R are engaged with a locking disk 774 and thus movement of the racks 64L and 64R are restricted. From this state, when the cam gear 77 is turned in the CCW direction in FIG. 6(*b*) by driving the motor 50, engagement between the racks 64L and 64R and the locking disk 774 is released and the drive teeth part 771 is engaged with the rack 64L to move the output member 6 upward. When the cam gear 77 is further turned in the CCW direction, engagement between the rack 64L and the drive teeth part 771 is released and then the racks 64L and 64R are engaged with the locking disk 774 to prevent movement of the racks 64L and 64R. Next, when the cam gear 77 is turned in the CCW direction, engagement between the racks 64L and 64R and the locking disk 774 is released and then the drive teeth part 771 is engaged with the rack 64R to move the output member 6 downward. When the cam gear 77 is further turned in the CCW direction, the engagement between the drive teeth part 771 and the rack 64R is released and the racks 64L and 64R are engaged with the locking disk 774 to return to a state as shown in FIG. 6(*b*).

The drive teeth part 771 and the locking disk 774 are integrally formed on the fifth gear 772 of the cam gear 77 on the rear end plate 52 side and a switch cam 773 is integrally structured on the fifth gear 772 on the motor 50 side. Switch contact pieces 78*a* and 78*b* which are held on the case 51 are disposed so as to be operated by a cam face of the switch cam 773. The switch contact pieces 78*a* and 78*b* are switched between an electrically opened state with their separation and an electrically closed state by their contacting with each other according to a turning angle of the cam gear and, as a result, a turning angle of the cam gear is detected.

The output member 6 is provided with a bar-shaped portion 61 which is straightly protruded upward from the housing 53 and a forward inclined portion 62 which is further extended upward from the bar-shaped portion 61 and then obliquely bent to a front side. The tip end parts of the forward inclined portions 62 are formed with two round bar-shaped slider parts 63L and 63R which are projected on both the right and left sides. The slider parts 63L and 63R are respectively fitted into the grooves 81L and 81R to structure slide mechanisms 10L and 10R (mechanical connected portion of the baffle 4 with the drive unit 5). The slide mechanisms 10L and 10R are located at inner side positions in a widthwise direction of the first turnable support part 9L and the second turnable support part 9R which are described with reference to FIG. 4(*e*) and located at positions apart from the turning center axial line "C".

The bar-shaped portion 61 of the output member 6 is penetrated through the opening part 513, i.e., an example of an output hole part, which is formed on a rear side of the upper face of the housing 53. In this embodiment, a moving extended axis "D" of the bar-shaped portion 61 is defined as a line which is formed by a center axis of the bar-shaped portion 61 at a position where the bar-shaped portion 61 is penetrated through the opening part 513. The center axis of the bar-shaped portion 61 traces a line in the direction of the center axis "D" of the bar-shaped portion 61, in other words, on a line of moving direction of the rack 64L. The moving extended axis "D" of the bar-shaped portion 61 is set to be near the turning center axial line "C".

A boundary portion of the output member 6 between the bar-shaped portion 61 and the forward inclined portion 62 is formed with a disk-shaped flange part 69 for preventing drops of water or the like from flowing from a tip end portion of the output member 6 to its bar-shaped portion 61 to cause to enter into the housing 53.

In the output member 6, an inner side of a connecting part of the bar-shaped portion 61 and the forward inclined portion 62 is formed to be thicker than other portion and thus damage of the output member 6 due to advancing-retreating operation can be prevented.

A groove part (not shown) is formed along a lengthwise direction on a side face of the output member 6. Therefore, strength against bending of the output member 6 is increased and thus damage of the output member 6 due to advancing-retreating operation can be prevented.

Figure 7A:
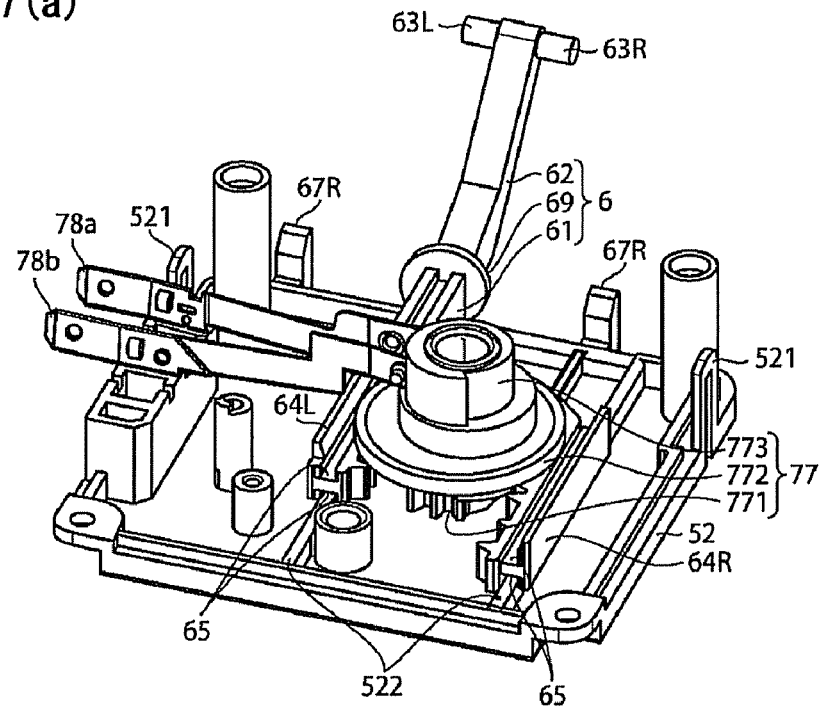
FIG. 7(*a*) is an explanatory perspective view showing a state where an output member is linearly moved through a linearly guide part formed in the rear end plate in the damper device shown in FIGS. 1(*a*) and 1(*b*), and FIG. 7(*b*) is an explanatory perspective view showing an engagement relationship between a linearly moving guide groove of the output member and the linearly guide part.
Figure 7B:
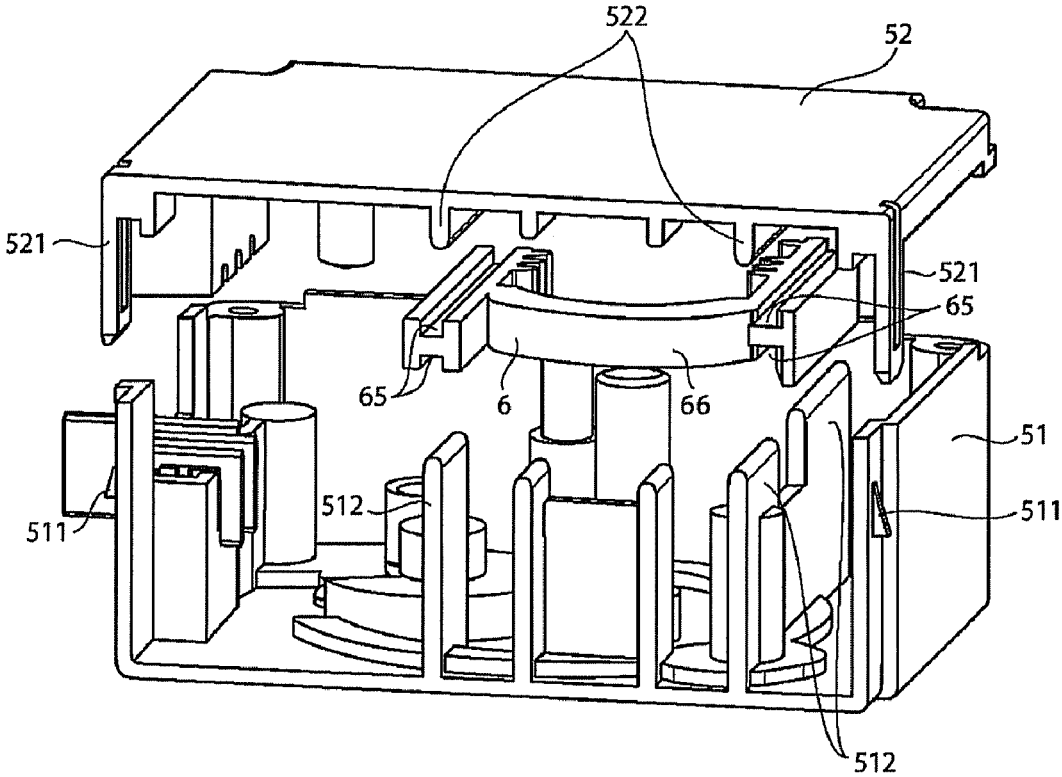

FIG. 7(*a*) is an explanatory perspective view showing a state where the output member is linearly moved through a linearly guide part formed in the rear end plate, and FIG. 7(*b*) is an explanatory perspective view showing an engagement relationship between a linearly moving guide groove of the output member and the linearly guide part.

Rack groove parts 65 are formed on faces of the racks 64L and 64R, which face the case 51 and the rear end plate 52, in an axial direction of the output member 6. Linear guide parts 512 are structured in the case 51 and linear guide parts 522 are structured in the rear end plate 52 in the axial direction of the output member 6. The rack groove parts 65 are engaged with the linear guide part 512 and the linear guide part 522 and thus the racks 64L and 64R are slidably held in the axial direction of the output member 6 and the output member 6 is linearly advanced and retreated.

In order to connect the drive unit 5 structured as described above to the under surface of the baffle unit 2, as shown in FIG. 5(*a*), the slider parts 63L and 63R which are formed at the tip end part of the output member 6 are inserted into the inner sides of the grooves 81L and 81R from the open end 810 sides of the grooves 81L and 81R to structure the slide mechanisms 10L and 10R.

Next, the drive unit 5 is turned downward around the slider parts 63L and 63R and the housing 53 of the drive unit 5 is set to be at a lower position of the frame 3. After that, a connecting plate part 371 of the frame 3 and a front face of the housing 53 of the drive unit 5 is fixed to each other with screws.

In order to combine the drive unit 5 with the baffle unit 2 in a connecting method as described above, in this embodiment, as described below with reference to FIGS. 1(*a*), 1(*b*), FIG. 2 and FIGS. 5(*a*) through 5(*c*), a positioning mechanism 11 for determining their relative position by engaging with each other and connection mechanisms 12L and 12R for combining the frame 3 and the drive unit 5 by fitting one to the other are structured between the drive unit 5 and the frame 3 of the baffle unit 2.

In this embodiment, as shown in FIGS. 1(*a*), 1(*b*), FIG. 2 and FIG. 5(*b*), in order to structure the positioning mechanism 11, a rectangular seat part 510 is protruded on the upper face of the housing 53 of the drive unit 5 where an base end portion of the output member 6 is protruded. On the other hand, a rear end portion of the bottom plate part 34 of the frame 3 of the baffle unit 2 is formed with a rectangular cut-out part 340 as the output hole part having substantially same dimension as the seat part 510. Therefore, when the drive unit 5 and the baffle unit 2 are to be connected with each other, the seat part 510 is fitted into the cut-out part 340 and thus positioning between the drive unit 5 and the baffle unit 2 is performed. Accordingly, in order to assemble the damper device 1, after the frame 3 and the drive unit 5 have been separately assembled, the frame 3 and the drive unit 5 can be easily and surely connected with each other with a high degree of positional accuracy. Further, the positioning mechanism 11 is structured in which the cut-out part 340 to which the seat part 510 is fitted is formed in the rear end portion of the bottom plate part 34. Therefore, the seat part 510 is easily fitted to the bottom plate part 34 and a cut-out portion of the bottom plate part 34 is required to be small.

Further, in this embodiment, as shown in FIGS. 1(*a*), 1(*b*), FIG. 2 and FIG. 5(*b*), the connection mechanisms 12L and 12R are structured in which an upper face (upper end part of the rear end plate 52) of the housing 53 of the drive unit 5 is formed with hook parts 67L and 67R which are protruded upward from the upper face of the housing 53 with a predetermined dimension and then bent forward. A gap space whose width is a little smaller than a width of the bottom plate part 34 of the frame 3 is formed between the tip end parts of the hook parts 67L and 67R and the upper face of the housing 53. Further, cut-out parts 341L and 341R to which the hook parts 67L and 67R are fitted are formed in the bottom plate part 34 of the frame 3. Therefore, when the drive unit 5 and the baffle unit 2 are to be connected with each other, the bottom plate part 34 of the frame 3 is inserted between the tip end parts of the hook parts 67L and 67R and the upper face of the housing 53 so that the hook parts 67L and 67R are fitted to the cut-out parts 341L and 341R. As a result, the hook parts 67L and 67R are resiliently bent upward and a state where the bottom plate part 34 of the frame 3 is inserted between the tip end parts of the hook parts 67L and 67R and the upper face of the housing 53 is maintained by shape return forces of the hook parts 67L and 67R. Therefore, when the damper device 1 is to be assembled, a lot of parts and man-hours are not required to connect the drive unit 5 with the frame 3.

Further, in this embodiment, as shown in FIG. 5(*c*), under faces of the tip end parts of the hook parts 67L and 67R are formed with a rib-shaped projection 670 which is extended in a fitting direction of the bottom plate part 34 of the frame 3. Therefore, when the bottom plate part 34 of the frame 3 is inserted between the tip end parts of the hook parts 67L and 67R and the upper face of the housing 53, the rib-shaped projections 670 are pressed so as to be deformed in a direction perpendicular to the fitting direction and thus the drive unit 5 and the baffle unit 2 are firmly connected with each other.

Figure 8:
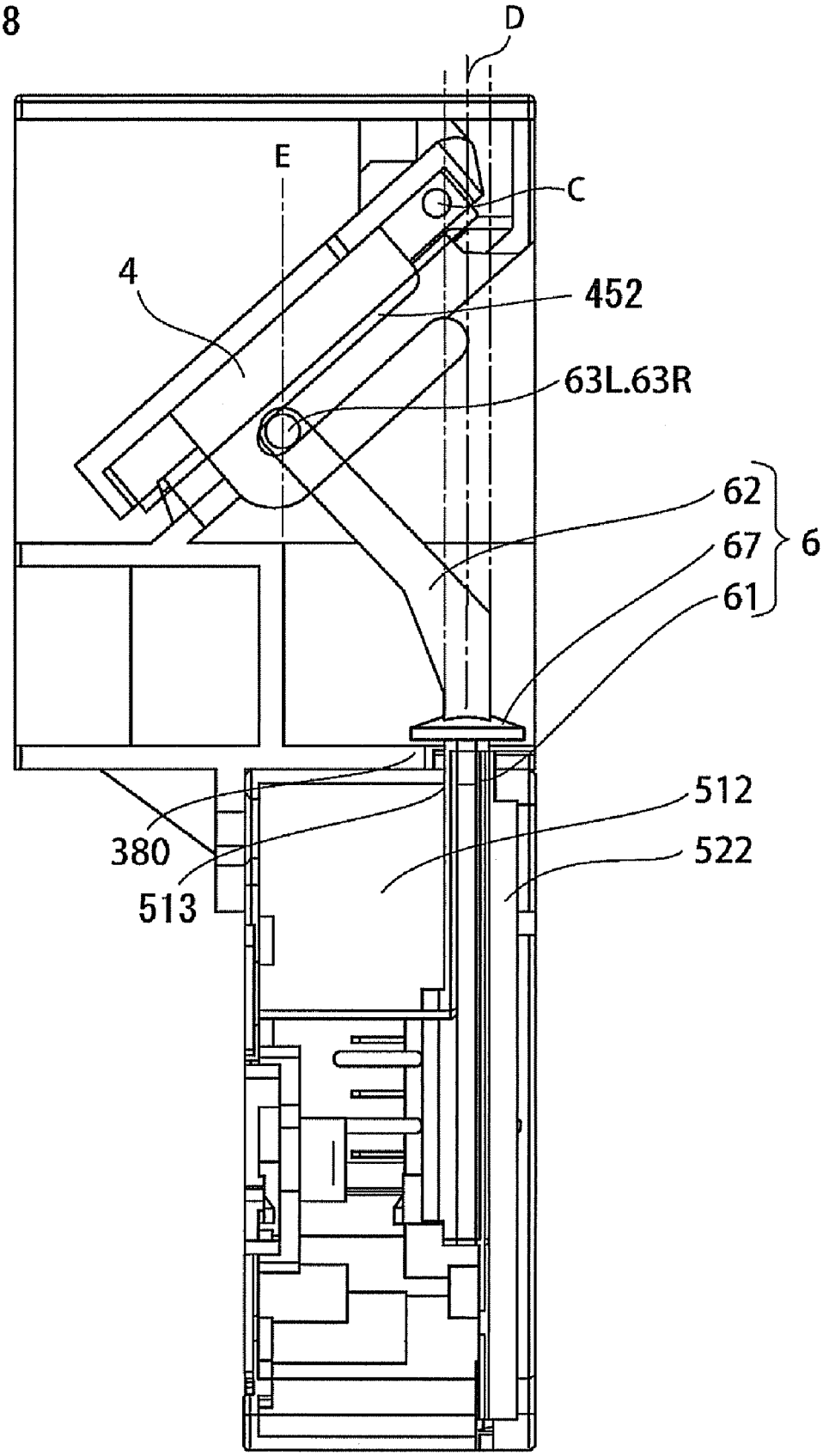
FIG. 8 is an explanatory view showing a relationship among a moving direction of the output member, a turning center axial line of the baffle, and an engagement part of the output member and the baffle in the damper device shown in FIGS. 1(*a*) and 1(*b*).

FIG. 8 is an explanatory view showing a relationship among the moving direction of the output member, the turning center axial line of the baffle, and an engagement part of the output member and the baffle in the damper device shown in FIGS. 1(*a*) and 1(*b*).

In this embodiment, as shown in FIG. 8, the turning center axial line "C" of the baffle 4 is located in the vicinity or near the moving extended axis "D" which is an extended axis of advancing-retreating operation of the output member 6 at a position where the output member 6 is penetrated through the opening part 513.

In the damper device 1 in this embodiment in a state as shown by the solid line in FIG. 2, the output member 6 has been moved downward to be located at a closing position where an opening part 30 (passage of cold air) is closed by the baffle 4. In this state, the slider parts 63L and 63R are located at the most apart position from the turning center axial line "C" in the grooves 81L and 81R. When the output member 6 is moved upward from this state, the rail portion 452 of the baffle 4 is pushed upward and turned around the turning center axial line "C" and thus the baffle 4 is moved to an open position as shown by the dotted line in FIG. 2. In this state, the baffle 4 causes the opening part 30 to open and the slider parts 63L and 63R have been moved along the grooves 81L and 81R in a direction coming near the turning center axial line "C".

When the output member 6 is moved downward from above-mentioned state, the arm parts 45L and 45R (rail portion) are pushed downward and the baffle 4 is turned around the turning center axial line "C" to be returned to the closed position as shown by the solid line in FIG. 2. In this case, the slider parts 63L and 63R are moved along the grooves 81L and 81R to positions apart from the turning center axial line "C".

In accordance with this embodiment, lengths of the grooves 81L and 81R are set to be sufficiently longer than a moving length of the slider parts 63L and 63R when the opening part 30 is opened and closed by the baffle 4. Therefore, even when dimension of part items and assembling dimension are dispersed, the slider parts 63L and 63R are not disengaged from the grooves 81L and 81R.

As described above, in this embodiment, since the baffle 4 is turned by advancing or retreating operation of the output member 6, structure can be simplified in comparison with a case that a turning shaft of the baffle 4 is directly driven to turn. Further, since the baffle 4 is turned by advancing or retreating operation of the output member 6, the mechanical connection part of the drive unit 5 with the baffle 4 may be structured at a position apart from the turning center axial line "C" of the baffle 4. Therefore, the baffle 4 is not required to drive at the turnable support parts 9L and 9R. Therefore, the drive unit 5 is not required to dispose on an extended line of the turning center axial line "C" and thus a width dimension of the damper device 1 can be reduced.

Further, in this embodiment, the output member 6 is formed to be bent to separate the mechanical connection part between the drive unit 5 and the baffle 4 from the moving extended axis "D" at a position where the output member 6 is penetrated through the opening part 513. Therefore, the positions of the mechanical connection parts 10L and 10R between the drive unit 5 and the baffle 4 and the position of the opening part 513 are not required to dispose on the same vertical line and thus degree of freedom for designing can be improved. Accordingly, a structure is easily attained in which the drive unit 5 is not protruded from the width dimension of the frame 3 and thus the thickness dimension of the damper device 1 can be reduced.

Further, in this embodiment, the moving extended axis "E" in the advancing-retreating operation of the slider parts 63L and 63R which are the engagement part with the baffle 4 is located further apart from the moving extended axis "D" of the output member 6 through the opening part 513 than the turning center axial line "C" of the baffle 4. Therefore, the baffle 4 can be turned with a small torque.

Further, in this embodiment, in order to adopt a structure for converting an advancing or retreating operation of the output member 6 to a turning operation of the baffle 4, the slider parts 63L and 63R are movable within the grooves 81L and 81R and one end portions of the grooves 81L and 81R are formed as an open end 810. Therefore, when the damper device 1 is to be assembled, the slider parts 63L and 63R are fitted from the open ends of the grooves 81L and 81R and thus assembling work can be easily and efficiently performed.

In addition, in order to form one end portions of the grooves 81L and 81R as the open end 810, the end parts of the grooves 81L and 81R which are located near the turning center axial line "C" are formed as the open end 810 and the end parts which are located at far side of the turning center axial line "C" are closed. Therefore, when the baffle 4 is moved from the open position as shown by the dotted line to the closed position as shown by the solid line in FIG. 2 to cause the buffer member 49 to be pressed to the tip end part of the rectangular frame part 36, a large force is applied to the arm parts 45L and 45R (rail portion 451). However, in this case, the slider parts 63L and 63R are located at the closed end parts of the grooves 81L and 81R and their strengths are large. Accordingly, deformation of the arm parts 45L and 45R (rail portion) can be prevented.

Further, in order to turnably support the baffle 4 on the frame 3, the turnable support parts 9L and 9R may be structured with the shaft parts 40L and 40R which are formed in the baffle 4 and the shaft holes 30L and 30R which are formed in the frame 3. According to the structure as described above, separate bearing parts from the baffle 4 and the frame 3 are not required. Therefore, number of part items is reduced and assembling can be easily and effectively performed.

Further, the damper device 1 in accordance with an embodiment of the present invention is used in a passage through which cold air is passed and thus temperature does not become higher. Therefore, even when the entire baffle plate 41 including the shaft parts 40L and 40R are made of resin, or even when the frame 3 is made of resin, deterioration due to temperature does not almost occur and thus cost of the damper device 1 can be reduced by an amount because resin is used.

In the embodiment described above, the bent portion of the output member 6 is formed at one position but a plurality of bent portions may be formed in the output member 6.

In the embodiment described above, an inflow port and an outflow port of the frame for flow path are disposed so as to be faced each other but the inflow port and the outflow port may be disposed so as to be perpendicular to each other.

In the embodiment described above, the output member 6 is bent on the forward side but the output member 6 may be bent on the rearward side.

In the embodiment described above, in the turnable support parts of the baffle 4, the shaft parts 40L and 40R are elastically displaceable in the axial directions of the shaft parts 40L and 40R. However, for example, the shaft holes 30L and 30R may be elastically displaceable in the axial directions of the shaft parts 40L and 40R by utilizing elastic deformation of the side plate parts 32L and 32R. Alternatively, both of the shaft parts 40L and 40R and the shaft holes 30L and 30R may be structured so as to be elastically displaceable in the axial direction of the shaft parts 40L and 40R.

In the embodiment described above, in order to structure the turnable support parts 9L and 9R of the baffle 4, the shaft parts 40L and 40R are formed in the baffle 4 and the shaft holes 30L and 30R are formed in the frame 3. However, the shaft parts 40L and 40R may be formed in the frame 3 and the shaft holes 30L and 30R may be formed in the baffle 4.

In the embodiment described above, the grooves 81L and 81R are formed in the baffle 4 and the slider parts 63L and 63R are formed in the output member 6 to structure the mechanical connecting portion of the baffle 4 with the drive unit 5. However, it may be structured such that the grooves 81L and 81R are formed in the output member 6 and the slider parts 63L and 63R are formed in the baffle 4. In this case, the former structure can be simplified. In other words, the baffle 4 is originally formed in a flat plate shape and thus a space for forming the grooves 81L and 81R is originally secured. Therefore, the structure can be simplified in comparison with a case that the grooves 81L and 81R are formed in the output member 6.

In the embodiment described above, the slide mechanisms 10L and 10R are formed on the abutting face side of the baffle 4 with the periphery of the opening part 30 when the opening part 30 is closed. However, the present invention may be applied to a damper device in which the slide mechanisms 10L and 10R are structured on an opposite side to the abutting face with the opening part 30 when the opening part 30 is closed.

In the embodiment described above, in order to form one end portions of the grooves 81L and 81R as the open end 810, the one end portions of the grooves 81L and 81R which are located near the turning center axial line "C" are formed as the open end 810 and the other end portions which are located far from the turning center axial line "C" are formed as the closed end. However, according to an operating condition for the baffle 4, it may be structured that the end portions of the grooves 81L and 81R which are located far from the turning center axial line "C" are formed as the open end 810 and the other end portions which are located near the turning center axial line "C" are formed as the closed end.

In the embodiment described above, the one end portions of the grooves 81L and 81R are formed as the open end 810 but both end portions of the grooves 81L and 81R may be formed as the open end 810. For example, it may be structured that rail portions are disposed on both sides of the slider parts 63L and 63R in a parallel and lifted state and outer sides of the rail portions are connected with the baffle plate 41.

In the embodiment described above, after the frame 3 and the drive unit 5 have been connected with the connection mechanisms 12L and 12R, the frame 3 and the drive unit 5 are fixed to each other with screws. However, the frame 3 and the drive unit 5 may be fixed to each other only with the connection mechanisms 12L and 12R.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A damper device comprising:

a frame which is provided with an opening part;

a baffle which is turnably supported on the frame to abut with the opening part and move away from the opening part;

a drive unit for turnably driving the baffle to open and close the opening part for opening and closing a passage structured to pass fluid;

the drive unit comprising:

an output member whose tip end side is provided with an engagement part with the baffle and which is linearly advanced and retreated to and from the baffle to turnably drive the baffle; and a driving part for advancing and retreating the output member; and a wall part which is provided between the driving part and the baffle and which is formed with an output hole part through which the output member is penetrated;

wherein the output member which passes through the output hole part is engaged with the baffle through the engagement part; and the engagement part is located apart from a first moving extended axis which is formed by movement of the output member penetrating through the output hole part;

wherein the wall part is structured by using a housing in which the driving part is held;

at least a part of the output member is structured to be adjacent to an inner wall of the housing;

a linear guide part which is engaged with at least a part of the output member is formed on the inner wall of the housing so that the linear guide part guides the output member to move linearly;

the turning axial line of the baffle is located on or in a vicinity of the first moving extended axis of the output member; and a width of the drive unit is set to be within a width of the frame in a direction where a second moving extended axis which is formed by movement of the engagement part is apart from and parallel to the first moving extended axis of the output member.

2. The damper device according to claim 1, wherein a turning axial line of the baffle is apart from a second moving extended axis which is formed by movement of the engagement part, and the turning axial line of the baffle is parallel to a flat face including the opening part.

3. The damper device according to claim 2, wherein the second moving extended axis of the engagement part is further apart from the turning axial line of the baffle than the first moving extended axis of the output member.

4. The damper device according to claim 1, wherein the engagement part is located at a position apart from the first moving extended axis of the output member through a bent portion which is formed in the output member.

* * * * *